United States Patent [19]

Meyrat

[11] 4,419,018

[45] Dec. 6, 1983

[54] ELECTRONIC WATCH WITH CONTROL MEANS FOR SELECTING AND CORRECTING TIME DATA

[75] Inventor: Clement Meyrat, Le Landeron, France

[73] Assignee: Ebauches Electroniques, S.A., Switzerland

[21] Appl. No.: 229,726

[22] Filed: Jan. 29, 1981

[30] Foreign Application Priority Data

Jan. 31, 1980 [CH] Switzerland ..... 766/80

[51] Int. Cl.[3] ..... G04G 5/04

[52] U.S. Cl. ..... 368/69; 368/187; 368/321

[58] Field of Search ..... 368/187, 188, 190, 185, 368/69, 319, 320, 321

[56] References Cited

U.S. PATENT DOCUMENTS

| | | | |
|---|---|---|---|
| 4,034,551 | 7/1977 | Ushiyama | 368/189 |
| 4,177,633 | 12/1979 | Miyamoto | 368/187 |
| 4,209,976 | 7/1980 | Flumm | 368/190 |
| 4,263,666 | 4/1981 | Murata | 368/187 |

*Primary Examiner*—F. W. Isen

*Attorney, Agent, or Firm*—Allegretti, Newitt, Witcoff & McAndrews, Ltd.

[57] ABSTRACT

The watch comprises a plurality of stores, each containing a particular item of time data and each producing an output signal representing the data therein. A single operating button is displaceable by the user of the watch, on the one hand in the axial direction between a pushed-in position and a pulled-out position for which a switch is respectively open and closed, and on the other hand rotatably. Rotation of the button closes and opens two more switches by two cams rotationally displaced so that two pulse trains are produced with a phase relationship indicating the sense of rotation. A circuit processes these pulse trains to produce UP pulse for one sense of rotation and DOWN pulses for the other sense of rotation. These pulses are used to correct the value in a selected store. The particular store to which the correction signal is applied is selected by axially displacing the operating button from the pushed-in position to the pulled-out position a predetermined number of times. A store selection circuit includes a counter which counts the pulls and selects the store in accordance with its count.

The stores are divided into a first group comprising the hour of the day store, the minute of the hour store, the day of the week store and the day of the month store and a second group comprising the alarm hour setting store and the alarm minute setting store. First selecting means in the circuit make possible the selection of one or other of the two groups of stores in response to rotary displacement of the button while still pushed in and seocnd selecting means including the counter than make it possible to select one store from the selected group in accordance with the number of times the button is pulled out.

4 Claims, 5 Drawing Figures

ELECTRONIC WATCH WITH CONTROL MEANS FOR SELECTING AND CORRECTING TIME DATA

BACKGROUND OF THE INVENTION

The present invention relates to electronic watches and more particularly to apparatus which makes possible the correction of data contained in a watch, such as data concerning the hour and minute indicated by the watch and the hour and minute of the alarm setting.

Known correcting and selecting means usually comprise several operating members, such as push-buttons, which are accessible to the user of the watch and serve, on the one hand, for the selection of data which the user wishes to see displayed and, on the other hand, for the correction of such data.

These known correcting and selecting means necessitate the use of a plurality of operating members, the number of which is a function of the number of different items of data that the watch can furnish. It is, however, undesirable, as much from the standpoint of manufacturing cost as from that of convenience of utilization of the watch, to multiply the number of operating members provided for effecting the corrections and selections of the data to be displayed.

Various different solutions have been put forward with a view to avoiding these disadvantages. For example, Swiss Patent Specification No 608,163 teaches the use, for the selection and correction of data contained in a watch, of a winder crown which can occupy any selected one of three stable axial positions, ie an intermediate neutral position, a pulled-out position and a pushed-in position. The selection of the item of data to be corrected is made by pulling out the winder crown one or more times, the winder crown being returned resiliently to its intermediate position. The correction of the selected data is effected by successive depressions of the winder crown, each depression causing the number constituting the selected data to increase by one. This known apparatus has in particular the disadvantage that it enables the correction to be effected in only one direction.

In addition, watches have been developed which have digital means as well as analogue means for indicating time data, the second-mentioned means usually consisting of hands driven by a stepping motor. It is desirable in this case to be able to correct at one and the same time identical data displayed simultaneously by the two display means. It is desirable in this case to be able to effect the correction of each kind of data in each of the two directions as required, ie in both the advance and retard directions.

British patent specification No. 2,019,052 discloses an electronic watch of this type which offers this possibility of bidirectional correction. In this known watch, the correction is effected with the aid of a rotatable button which operates contacts which make possible the detection of the direction of rotation of the button in order to effect the correction in the advance or retard direction and the production of the pulses which produce the correction. However, in this known watch, the correction is effected by means of several operating members, as a result of which the correction operation is difficult for the user. This known watch comprises in effect, in addition to the rotatable button, an operating member for the selection of data displayed and another operating member for bringing about the change over from the normal operating condition of the watch to the correction condition.

SUMMARY OF THE INVENTION

Accordingly one of the objects of the invention is to provide a watch with an apparatus for the selection and correction of data, which apparatus requires only one operating member.

Another object of the present invention is to provide a watch with correcting and selecting means which enables the correction of each item of data to be effected in both directions.

According to the present invention, the electronic watch comprises a plurality of stores, each containing a particular item of time data and each producing an output signal representing the time data therein. A selecting and correcting means comprises an operating element which can be actuated by the user of the watch, correcting means responsive to the actuation of the operating means to produce a correction signal and selecting means responsive to the condition and actuation of the operating element to select a particular store, to apply the correction signal thereto and to apply the output signal of this selected store to a display device. The operating element is displaceable by the user of the watch in the direction of a first degree of freedom, such as axially, between first and second predetermined positions and also in the direction of a second degree of freedom, such as rotationally. The correcting means comprise means responsive to the positioning of the operating element in the direction of the first degree of freedom in the second position and to the displacement of the operating element in the direction of the second degree of freedom, to produce the correction signal, the value of which is a function of these displacements.

According to a preferred embodiment of the invention, the stores of the watch are divided into a first group comprising stores for data relating to the hour of the day, the minute of the hour, the day of the week (ie name of the day) and the day of the month (ie the day date) and a second group comprising stores for data relating to the hour of the alarm setting and the minute of the alarm setting. Selector means make it possible, when the operating member is in the first position, to select one or other of these two groups of stores by a displacement which is imparted to the operating member in the direction of the second degree of freedom. Further selecting means then enable a particular store of the selected group to be selected according to the number of movements of translation imparted to the operating element in the direction from the first position to the second position.

DESCRIPTION OF THE PREFERRED EMBODIMENT

Figure 1:
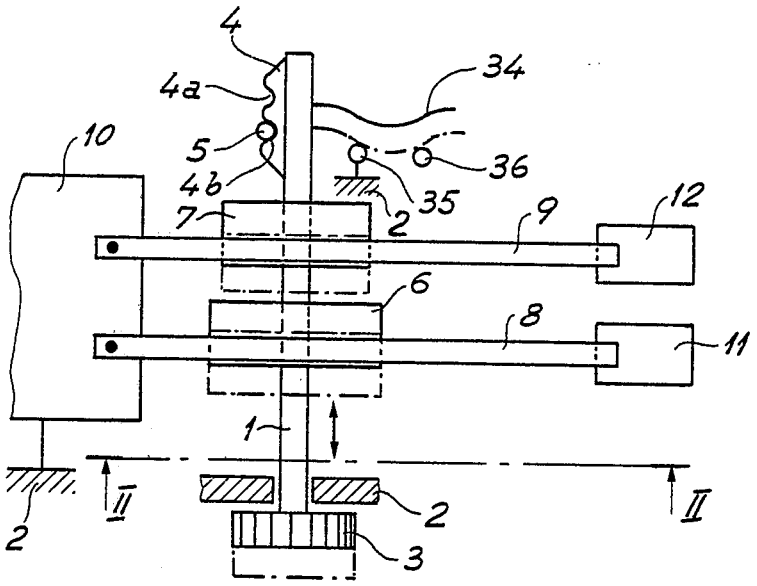
FIG. 1 is a schematic plan view of an operating button and of transducers associated therewith, according to one embodiment of the invention.
Figure 2:
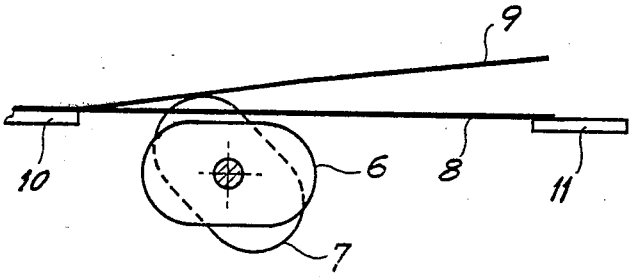
FIG. 2 is a fragmentary diagrammatic section taken on the line II—II of FIG. 1.

In FIG. 1 there is shown a control button having a stem 1 which is guided for axial movement in the body of the case 2 of an electronic watch. The stem 1 is provided, on the part thereof which projects outside the case 2, with an operating crown 3. On the stem 1 is fixed a resiliently flexible element 4 formed with two notches 4*a*, 4*b* which can receive successively a projection 5 fixed in the case 2 of the watch. This arrangement 4, 5 enables the stem to be located as required in either one of two stable predetermined axial positions. Keyed on the stem 1 are two cams 6 and 7 which are of identical shape and are phase-displaced with respect to each other by an angle of 45°. The cams 6 and 7 cooperate respectively with electrically conductive, resiliently flexible strips 8 and 9 which are fixed at one end to an electrically conductive member 10 which in turn is electrically connected to the case 2 of the watch, while the other end of each of these strips 8 and 9 is arranged so as to be alternately applied against and removed from a corresponding contact 11 or 12.

When the stem 1 is rotated about its axis, two signals are produced each of which is formed of a series of pulses having a frequency that is dependent on the speed of rotation of the stem 1.

Figure 3:
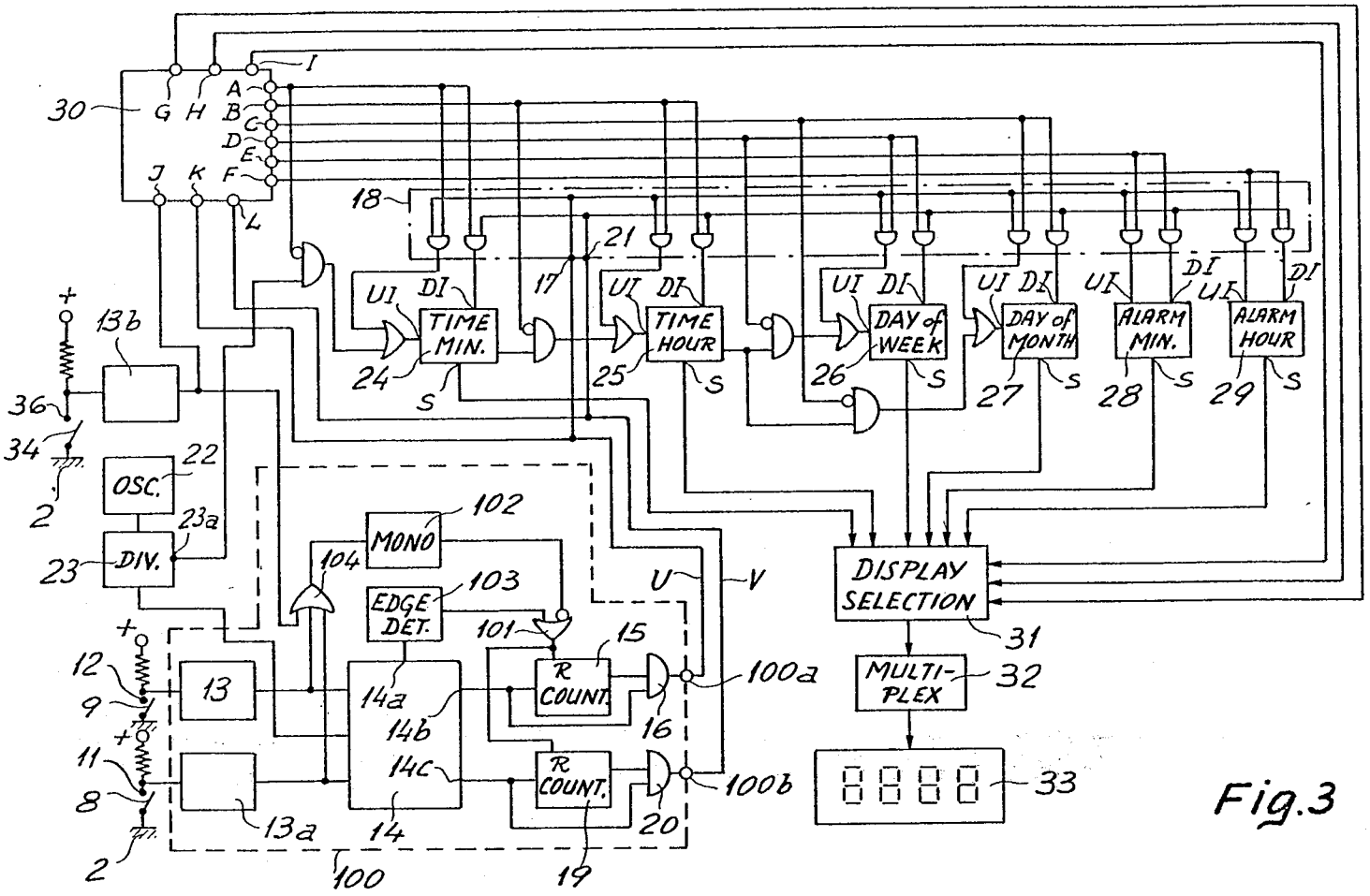
FIG. 3 is a block diagram of an electronic watch provided with a selecting and correcting apparatus according to an embodiment of the invention.

As can be seen from FIG. 3, each of the contacts 11 and 12 is connected to the positive terminal of a source of electric current for driving the watch. Each contact 11 and 12 is likewise connected via a respective anti-surge circuit 13*a* or 13 to a respective input of a circuit 14 of known type which is capable of producing at a first output 14*a* a logical signal the state of which depends on the direction of rotation of the stem 1 and at a second or third output 14*b* or 14*c* a pulsating signal the frequency of which is proportional to the speed of rotation of the stem 1. The output 14*b* will emit a signal when the stem 1 is rotated in one direction and the output 14*c* will emit a signal when the stem 1 is rotated in the other direction.

The output 14*b* is connected via a counter by three 15 and an AND gate 16 to an UP-counting input 17 of a selector circuit 18. The output 14*c* is connected via a counter by three 19 and an AND gate 20 to a DOWN-counting input 21 of a selector circuit 18.

The circuit 14, as well as the parts 13, 13*a*, 15, 16, 19 and 20 and other parts which will be described later form a circuit 100 whicch generates a signal U, V for correcting the data contained in the stores 24 to 29.

As can be seen from FIG. 3, the electronic watch shown therein comprises in known manner a time base generator, such as a quartz oscillator 22, a divider 23 which produces at its output 23*a* a pulsating signal having a frequency of one pulse per minute, a minute of the hour store 24, an hour of the day store 25, a day of the week store 26, a day of the month store 27, a minute of alarm setting store 28 and an hour of alarm setting store 29. Each of the stores 24 to 29 is constituted in known manner by an UP and DOWN counter the UP-counting input UI or the DOWN-counting input DI of which is adapted to be connected to the UP-counting input 17 or the DOWN-counting input 21 respectively of the selector 18 according to the state of the outputs A, B, C, D, E, F of a control circuit 30, as will be explained later.

Moreover, each store 24 to 29 produces at its data output S a signal which is representative of the state of the store in question, which signal is transmitted to a display selecting circuit 31. The last-mentioned circuit, which comprises in known manner AND gates, is arranged to apply to a multiplexing and control circuit 32 of a liquid crystal display device 33 either the output signals supplied by the stores 24 and 25 or those of the stores 28 and 29 according to the state of the outputs G, H and I of the control circuit 30, as will be explained later.

Referring again to FIG. 1, it will be seen from this figure that an electrically conductive, resiliently flexible strip 34 is fixed to the stem 1. When the stem 1 is in the axially pushed-in position indicated in full lines in FIG. 1, the strip 34 is located at a distance from the two contacts 35, 36, one, 35, of which is electrically connected to the case 2 and is thus earthed.

Returning to FIG. 3, it will be seen that the contact 36 is connected on the one hand to the positive pole of the electric current supply source of the watch and on the other hand, via a surge-suppressing circuit 13*b*, to an input J of the control circuit 30. It will also be clear from FIG. 3 that the control circuit 30 receives in addition, at its input K, an incremental signal U from the output 14*b* of the circuit 14 and, at its output L, a decremental signal V from the output 14*c* of the circuit 14.

In order to allow correction of a store only when the button composed of the stem 1 and the crown 3 is in the pulled-out position shown in chain-dotted lines in FIG. 1, the control circuit 30 is arranged to produce a logical signal "1" at an output A, B, C, D, E, F only when a logical signal "0" is present at its input terminal J. For this purpose, as shown in FIG. 4, each of the said outputs A to F of the circuit 30 is connected to the output of a respective one of the AND gates 37*a* to 37*f*, each of which gates has an inverting input connected to the terminal J.

Figure 4:
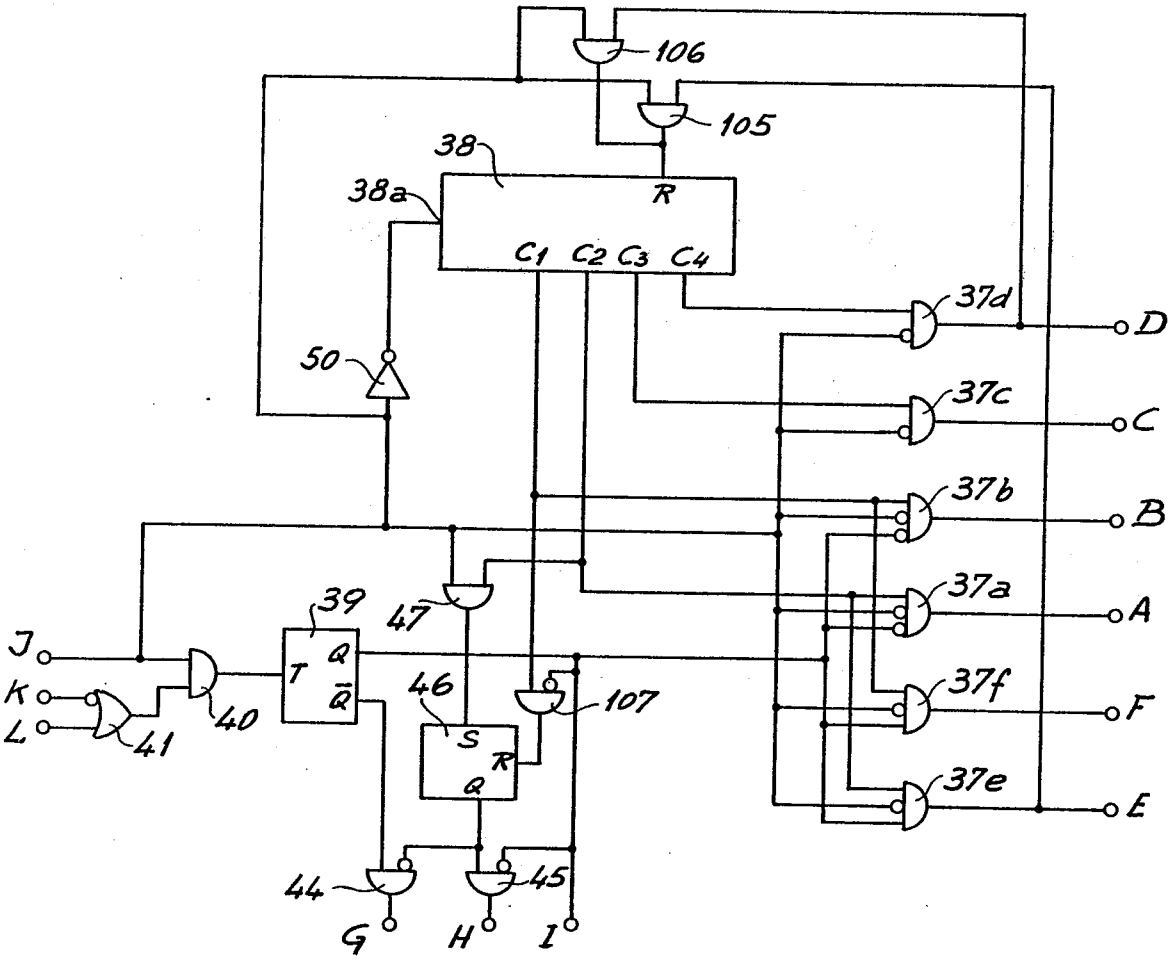
FIG. 4 is a block diagram of a control circuit employed in the apparatus illustrated by the diagram of FIG. 3.

In addition, the circuit shown in FIG. 4 enables the following corrections to be effected successively: the correction of each store of a first group of stores, comprising the store 29 for the hour of the alarm setting and the store 28 for the minute of the alarm setting, as well as the correction of each store of a second group of stores comprising in succession the hour of the day store 25, the minute of the hour store 24, the day of the month store 27 and the day of the week store 26.

For this purpose, as shown in FIG. 4, the control circuit 30 comprises a counter 38 which counts the rising edges and has its UP-counting input 38*a* connected via an inverter 50 to the terminal J. The counter 38 has four outpts C1, C2, C3 and C4 which provide successively a logical signal "1" when the said counter has counted respectively 1, 2, 3 and 4 rising edges applied to its input 38*a*. The outputs C1 to C4 of the counter 38 are connected to non-inverting inputs of the AND gates 37*b*, 37*a*, 37*c* and 37*d* respectively. The outputs C1 and C2 are also connected respectively to non-inverting inputs of the AND gates 37*f* and 37*e*.

Thus, provided that the terminal J is in the "0" state, i.e. provided that the button 1, 3 is in the pulled-out condition, a "1" will appear successively at the terminals B, A, C and D when the counter 38 has counted respectively 1, 2, 3 or 4 rising edges applied to its input 38*a*, that is to say when the button 1, 3 has been moved from its pushed-in position to its pulled-out position 1, 2, 3 or 4 times. In each of these cases, it is possible to correct successively the data concerning hour of the day, the minute of the hour, the day of the month and the day of the week by means of elementary correction signals U, V supplied by the circuit 100.

The circuit 30 is likewise arranged to permit the successive correction of data concerning the hour of the alarm setting and the minute of the alarm setting in the same manner as the correction of that of the other data of the watch, i.e. with the aid of elementary correction signals U and V and when the button 1, 3 is in the pulled-out state.

For this purpose, as shown in FIG. 4, the circuit 30 includes a toggle-type flip-flop 39 the input T of which is connected to the output of an AND gate 40. One input of the AND gate 40 is connected to the output of an OR gate 41 the inputs of which are connected to the terminals K and L respectively of the circuit 30. The AND gate 40 has a second non-inverting input which is connected to the input terminal J.

The Q output of the flip-flop 39 is connected to an inverting input of each of the AND gates 37*a, b, e, f* as well as being connected to a non-inverting input of each of the AND gates 37*e* and 37*f* which are associated respectively with the outputs E and F of the circuit 30.

The display selecting circuit 31 is arranged in such a manner that the display device 33 displays simultaneously data concerning the hour of the day and the minute of the hour when the terminal G is in the "1" state, data concerning the day of the week and the day of the month when the terminal H is in the "1" state and data concerning the alarm hour setting and the alarm minute setting when the terminal I is in the "1" state. The selector circuit 31 can easily be worked out by any technician who is skilled in the art and has therefore not been shown in detail in the drawings.

The control circuit 30 has been arranged so that, at the end of the correction cycle, the display device 33 displays simultaneously data concerning the day of the week and the day of the month. Moreover, when the cycle of operations for the correction of the stores of the first group as well as that of the stores of the second group has been completed, it is necessary that the display device 33 should display the data which is in the course of being corrected.

With these ends in view, the terminals G and H are connected to the outputs of two AND gates 44 and 45 respectively while the terminal I is connected directly to the output Q of the flip-flop 39. The circuit 30 also comprises a second RS-type flip-flop 46 the input R of which is connected to the output of an AND gate 47, the output Q of which is in turn connected to one input of the AND gate 45 and the reset-to-zero input R of which is connected to the output C1 of the counter 38. The AND gate 47 has two inputs which are connected respectively to the terminal J and to the output terminal C2 of the counter 38. Lastly, the AND gate 44 has an inverting input which is connected to the output Q of the fli-flop 46 and a non-inverting input which is connected to the output Q of the flip-flop 39. The gate 45 also has an inverting input which is connected to the terminal I and a non-inverting input which is connected to the output Q of the flip-flop 46.

The operation of the watch apparatus shown in FIGS. 1 to 4 will now be described with reference to these figures and to FIG. 5.

When the stem 1 is rotating about its central longitudinal axis, the contacts 8 and 9 open and close periodically and a periodic pulse signal, the frequency of which is proportional to the speed of rotation of the stem 1, is produced at the fixed contact 11. In order to avoid having to take account of unintentional rotations of the stem 1 about its central longitudinal axis, there are inserted between the outputs 14*b* and 14*c* of the circuit 14 on the one hand and the corresponding outputs 100*a* and 100*b* of the error signal generating circuit 100 on the other hand counters by three 15 and 19 respectively, the function of which is to transmit the pulses present at these outputs 14*b* and 14*c* only after three first pulses have appeared at these same outputs 14*b* and 14*c*. The reset-to-zero terminals R of the counters 15 and 19 are connected to the output of an OR gate 101 having an inverting input connected to the output of a monostable 102. Another input of the OR gate 101 is connected to the output of an edge-detecting circuit 103 which detects the edges of the signal which indicates the direction of rotation of the stem 1 and which appears at the output terminal 14*a* of the circuit 14. The input of the monostable 102 is connected to the output of an OR gate 104 having three inputs connected respectively to the output terminals of the surge-suppressing circuits 13, 13*a* and 13*b*. The circuit 14 comprises two D-type flip-flops which are clocked by pulses from the divider 23 and responsive to the input signals from the anti-surge circuits 13 and 13*a*. Gates within the circuit 14 process the signals at the outputs of the flip-flops so that UP pulses appear at the terminal 14*b* in response to the edges of the said input signals when the falling and rising edges of the first input signal occur while the second input signal is respectively at "1" level and "0" level. Conversely, DOWN pulses appear at the terminal 14*c* in response to the edges of the said input signals when the falling and rising edges of the first input signal occur while the second input signal is respectively at "0" level and "1" level.

Figure 5:
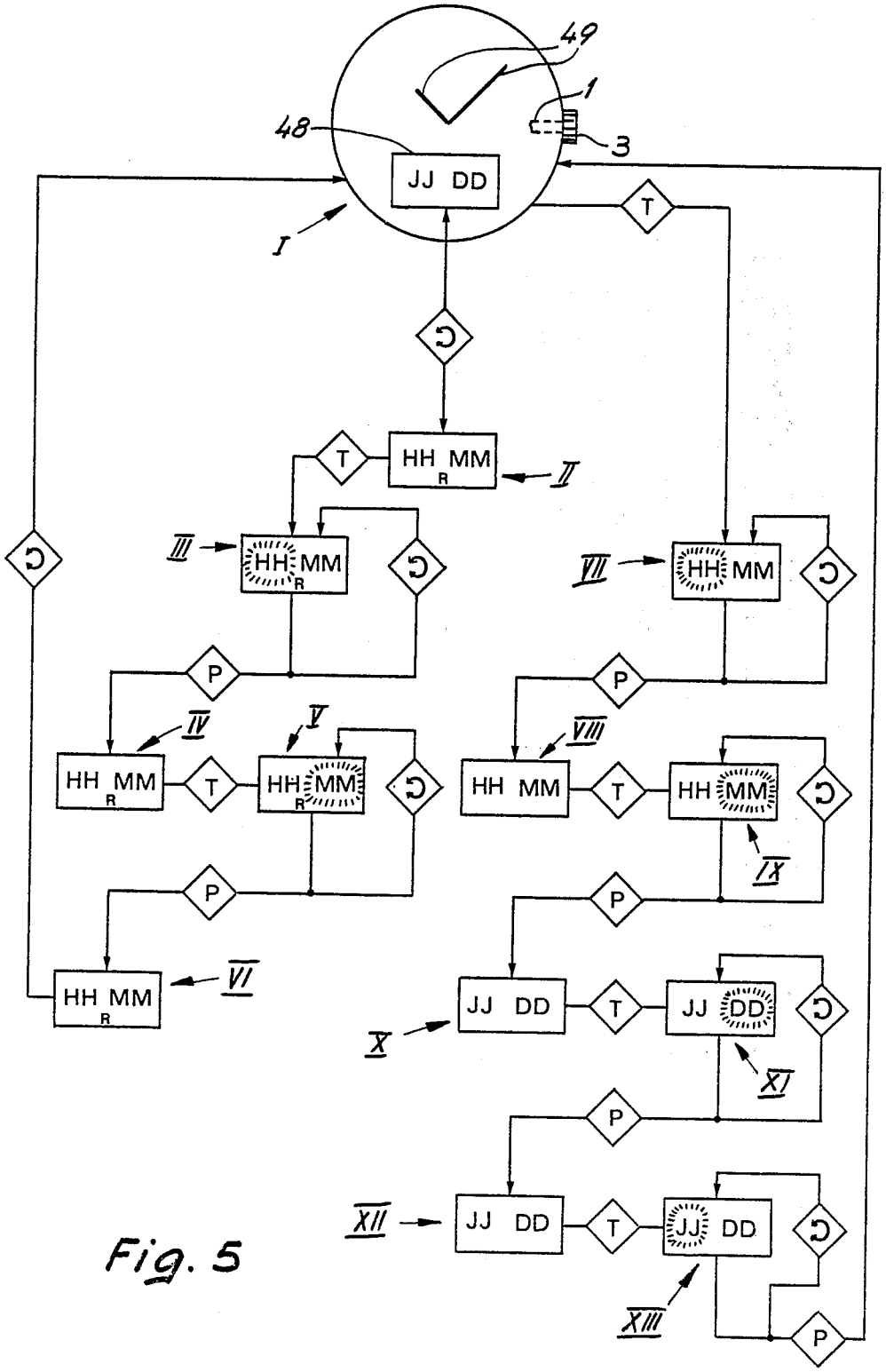
FIG. 5 is a schematic drawing which illustrates diagrammatically the several operations that must be performed for correcting the data contained in the watch according to the block diagram of FIG. 3.

In FIG. 5, the letters T and P enclosed within diamond-shaped surrounds represent respectively pulling and pushing operations performed by the user of the watch in order to cause the rotatable button 1, 3 to move from one axial position to the other. In this figure, the double arrows likewise enclosed within diamond-shaped surrounds indicate rotation of the button 1, 3 in one direction or the other. In the selected example, the watch has a crystal liquid digital display cell 48 as well as an analogue time-indicating means constituted by hands 49.

When the watch is functioning normally, the display cell 48 displays the day of the week indicated in the drawing by the letters JJ, as well as the day of the month indicated in the drawing by the letters DD, while the hours and minutes are indicated by the hands 49. This condition is represented in FIG. 5 by the Roman numeral I. The button 1, 3 is then in its pushed-in position which will be referred to subsequently as the "first position".

When the button 1, 3 is rotated in one direction or the other while it is maintained in this first position, a first pulse of the signal U or of the signal V is caused to appear, giving a logical "1" to one of the inputs K, L of the circuit 30. This actuates the flip-flop 39 so that the output Q thereof is given a "1". In the initial state indicated by the Roman numeral I in FIG. 5, the flip-flop 46 is actuated so that the output Q thereof is given a "1", so that a logical signal "1" is maintained at the output terminal H of the circuit 30. When the terminal H is at "1", the cell 48 displays the day of the week JJ as well as the day of the month DD.

When the flip-flop 39 is actuated, the state of the output I of the circuit 30 changes over from "0" to "1", causing the terminal H to assume the state "0". When the terminal I is in the state "1", the cell 48 displays the alarm hour setting H as well as the alarm minute setting MM, while the cell 48 displays in addition the letter R.

It has thus been shown that rotation of the button 1, 3 by a predetermined angular amount produces the display of the alarm hour setting and the alarm minute setting. This operation has no effect on the analogue indication of the time by the hands 49. A further rotation of the button 1, 3 will enable the display of the day of the week and the day of the month to be resumed.

When it is desired to change the hour and minute of the alarm setting, it is first of all necessary to cause these items of data to be displayed by the cell 48. The state indicated in FIG. 5 by the Roman numeral II is then attained. When a pull T is applied to the button 1, 3 in order to displace the latter to the pulled-out or second position, the input terminal J of the circuit 30 is changed over from the logical value "1" to the logical value "0". This causes a logical signal "1" to appear at the output C1 of the counter 38 and simultaneously brings about the opening of the AND gates 37*b* and 37*f*. A logical "1" then appears at the output terminal F whereby the correction signal U, V is switched to the alarm setting hour store 29. The modification of the alarm hour setting data is then effected by means of this correction signal U, V. As can be seen from FIG. 5, electronic means (which are not shown in FIGS. 3 and 4 but can easily be constructed and arranged by a technician who is skilled in the art) produce a flashing on and off by the cell 48 of the indication of the hour of the alarm setting. When the button 1, 3 is pushed back to its first position and then pulled out so as to return it to its second position, a logical "1" signal will be caused to appear at the output terminal C2 of the counter 38, which in turn will cause a logical "1" signal to appear at the terminal E. This switches over the correction signal U, V to the minutes of alarm setting store 28 and the alteration of the data contained in this store can be effected in the same manner as before. A pushing of the button 1, 3 into its first position followed by a rotation of this button by a predetermined angular amount brings about the return to the condition I.

A first correction cycle, which in the example illustrated is concerned exclusively with data relating to the hour and minute of the alarm setting, has thus been completed.

If, starting from the condition I, a pull T is applied to the button 1, 3 so as to move this button to its second position, a logical signal "1" is caused as before to appear at the output of the counter 28. However, in this case, the flip-flop 39 is not actuated, so that the output Q thereof is in the state "0", which causes the AND gate 37*e* and 37*f* to be closed and the gates 37*a* and 37*d* to be opened. A logical signal "1" will then appear at the terminal B, whereby the correction signal U, V is switched over to the hour of the day store 25. As before, it is possible to correct the data contained in this store with the aid of the correction signal U, V. This condition is indicated by the Roman numeral VII in FIG. 5.

Simultaneously, the flip-flop 46 is returned to zero, thereby causing data concerning the hour of the day HH and the minute of the hour MM to be displayed.

A pushing-in of the button 1, 3 so as to return it to its first position, followed by a pulling out thereof to its second position causes a signal "1" to appear at the terminal A. The correction signal U, V is now switched over to the minute of the hour store 24 and the condition IX is attained. A return of the button 1, 3 to its first position actuates the flip-flop 46, the input S of which is set at "1" by the return to the state "1" of the terminal J.

It will easily be understood that, in the same way, the terminals C and D of the circuit 30 are successively set at "1", thereby bringing about the correction of the day of the month store 27 and of the day of the week store 26.

A second correction cycle, which in the example illustrated is concerned with data relating to the hour of the day, the minute of the hour, the day of the month and the day of the week, has thus been completed.

It is to be noted that the counter 38 is reset to zero when the first correction cycle is brought about by a depression P of the button 1, 3 while the system is in the condition V in which a logical "1" is present at the terminal E. For this purpose, the reset-to-zero terminal R of the counter 38 is connected to the output of an AND gate 105 which has two inputs respectively to the terminals E and J respectively.

The counter 38 is likewise reset to zero at the end of the second correction cycle, the system then being in the condition XIII in which a logical "1" is present at the terminal D, as a result of a pushing-in P of the button 1, 3 which causes a logical "1" signal to appear at the terminal J. For this purpose, the reset-to-zero terminal R of the counter 38 is connected to the output of an AND gate 106 having two inputs connected to the terminals J and D respectively.

In order to prevent resetting to zero of the flip-flop 46 as a result of the appearance of a "1" at the output C1 in the course of the first correction cycle, an AND gate 107 is inserted between the reset-to-zero terminal R of this flip-flop and the terminal C1. The gate 107 has an output connected to the terminal R of the flip-flop 46, an inverting input connected to the terminal I and a non-inverting input connected to the terminal C1.

Known arrangements (not shown) enable the hours and/or minutes indicated by the hands 49 to be corrected by means of the same correction signal U, V at the same time as the data concerning the hour of the day HH and the minute of the hour MM.

An apparatus has thus been provided which, on the one hand, enables data to be displayed to be selected by turning the button 1, 3 when the latter is in its first axial position and on the other hand enables data to be corrected to be selected by displacing this button 1, 3 between its first and second axial positions, the number of these axial displacements determining the data that can be corrected. This apparatus then enables the data thus selected to be corrected by rotating the button 1, 3 when the latter is in its second axial position, the correction being effected in the advance direction with the aid of the signal U or in the retard direction with the aid of the signal V according to the direction of rotation of the button.

What I claim is:

1. An electronic watch comprising:

a plurality of stores, each containing a particular item of time data and each producing an output signal representing the time date therein;

a digital display device; and control means comprising a control button displaceable by the user of the watch on the one hand axially between a pushed-in and a pulled-out stable position and on the other hand rotatably, correcting mean responsive to the rotation of the control button while said control button is in said pulled-out position, to provide a correction signal, and selecting means responsive to displacements of said control button from said pushed-in to said pulled-out position to select, from among at least some of said stores, a particular store which is selected as a function of the number of said displacements, to apply the output of the selected store to said display device and to apply said correction signal to said store in order to modify the contents of it.

2. A watch according to claim 1 wherein said stores are divided into at least a first and a second group of stores and wherein said selecting means comprise group-selecting means responsive to a rotation of said control button while it is in the pushed-in position, to select the first or second group of stores and store-selecting means responsive to displacements of the control button from the pushed-in to the pulled-out position to select in sequence the stores of the selected group.

3. A watch according to claim 2 wherein said selecting means comprise means for selecting what is displayed which are responsive to the rotation of the control button while it is in the pushed-in position to select from among at least same of said stores of the watch at least one particular store as a function of the magnitude of this rotation and to apply the output signal of this store to said display device.

4. A watch according to claim 1 wherein said correcting means comprise a first converter responsive to the rotary displacement of said control button to supply at least a correction signal formed of a series of pulses the frequency of which is a function of the speed of rotation of said button and said selecting means comprise a second converter responsive to the positioning of said button in said pushed-in or pulled-out position to supply an axial position signal the value of which depends on the axial position of said button.

* * * * *